US011952027B2

(12) United States Patent
Xu et al.

(10) Patent No.: US 11,952,027 B2
(45) Date of Patent: Apr. 9, 2024

(54) TRAIN IDENTIFICATION SYSTEM AND METHOD, AND TRAIN SAFETY INSPECTION SYSTEM AND METHOD

(71) Applicant: NUCTECH COMPANY LIMITED, Beijing (CN)

(72) Inventors: Yanwei Xu, Beijing (CN); Weifeng Yu, Beijing (CN); Yu Hu, Beijing (CN); Shangmin Sun, Beijing (CN)

(73) Assignee: NUCTECH COMPANY LIMITED, Beijing (CN)

( * ) Notice: Subject to any disclaimer, the term of this patent is extended or adjusted under 35 U.S.C. 154(b) by 515 days.

(21) Appl. No.: 17/287,116

(22) PCT Filed: Oct. 8, 2019

(86) PCT No.: PCT/CN2019/109923

§ 371 (c)(1),
(2) Date: Apr. 21, 2021

(87) PCT Pub. No.: WO2020/008197

PCT Pub. Date: May 7, 2020

(65) Prior Publication Data

US 2021/0354738 A1 Nov. 18, 2021

(30) Foreign Application Priority Data

Nov. 1, 2018 (CN) ..... 201811293771.9

(51) Int. Cl.
*B61L 27/60* (2022.01)

(52) U.S. Cl.
CPC ..... *B61L 27/60* (2022.01)

(58) Field of Classification Search
CPC ..... B61L 1/00; B61L 25/02; B61L 25/021; B61L 25/025; B61L 25/04; B61L 27/40; B61L 27/57; B61L 27/60
See application file for complete search history.

(56) References Cited

U.S. PATENT DOCUMENTS

2005/0125113 A1* 6/2005 Wheeler ..... B61L 27/40 701/19
2005/0205719 A1* 9/2005 Hendrickson ..... B61L 15/0081 246/122 R (Continued)

FOREIGN PATENT DOCUMENTS

CN 101468651 B 3/2011
CN 102592456 A 7/2012

(Continued)

OTHER PUBLICATIONS

English translated Written Opinion for PCT/CN2019/109923, dated Jan. 2, 2020. (Year: 2020).*

(Continued)

*Primary Examiner* — Calvin Cheung

(57) ABSTRACT

The present disclosure relates to a train identification system and method, and a train safety inspection system and method. The train identification system includes: a remote detection component, configured to acquire overall feature information of an inspected train through remote monitoring; and an identification device, configured to determine at least one of a type and a traveling situation of the inspected train according to the acquired overall feature information.

15 Claims, 2 Drawing Sheets

(56) References Cited

U.S. PATENT DOCUMENTS

| | | | | |
|---|---|---|---|---|
| 2005/0253689 | A1* | 11/2005 | Mollet | B61L 27/70 340/286.01 |
| 2007/0124332 | A1* | 5/2007 | Ballesty | B61L 27/57 |
| 2007/0146159 | A1* | 6/2007 | Kato | B61L 25/025 340/8.1 |
| 2007/0150129 | A1* | 6/2007 | Davenport | B61L 17/00 701/19 |
| 2007/0150130 | A1* | 6/2007 | Welles | B61L 25/025 701/19 |
| 2007/0219681 | A1* | 9/2007 | Kumar | B61L 25/021 701/19 |
| 2007/0219682 | A1* | 9/2007 | Kumar | B61L 3/006 701/19 |
| 2007/0276555 | A1* | 11/2007 | Kiss | B61L 17/00 701/19 |
| 2009/0187291 | A1* | 7/2009 | Daum | B61L 3/006 701/19 |
| 2010/0119207 | A1* | 5/2010 | Hwang | H04N 21/8456 348/143 |
| 2010/0163687 | A1* | 7/2010 | Brand | B61L 23/041 246/111 |
| 2011/0238241 | A1* | 9/2011 | Brady | B61L 25/025 701/19 |
| 2016/0257323 | A1* | 9/2016 | Meyer | B61L 3/006 |
| 2016/0321513 | A1* | 11/2016 | Mitti | G06V 20/63 |
| 2017/0013237 | A1* | 1/2017 | Ito | B61D 1/00 |
| 2017/0155875 | A1* | 6/2017 | Shubs, Jr. | G06T 7/73 |
| 2017/0161586 | A1* | 6/2017 | Xu | G06V 20/52 |
| 2017/0186172 | A1 | 6/2017 | Xu et al. | |

FOREIGN PATENT DOCUMENTS

| | | | |
|---|---|---|---|
| CN | 103413325 | A | 11/2013 |
| CN | 103679221 | A * | 3/2014 |
| CN | 105426922 | A | 3/2016 |
| CN | 105575125 | A | 5/2016 |
| CN | 205365645 | U | 7/2016 |
| CN | 106054271 | A | 10/2016 |
| CN | 107845264 | A | 3/2018 |
| CN | 107985347 | A | 5/2018 |
| CN | 108320522 | A | 7/2018 |
| CN | 109178040 | A | 1/2019 |
| CN | 209395825 | U | 9/2019 |
| EP | 3178719 | A1 | 6/2017 |
| EP | 3273275 | A1 | 1/2018 |
| JP | 2017030380 | A | 2/2017 |
| KR | 101849777 | B1 | 4/2018 |
| WO | 2008132130 | A1 | 11/2008 |
| WO | 2018153254 | A1 | 8/2018 |

OTHER PUBLICATIONS

CN 106054271 A with English translation; filing date Jul. 22, 2016; published date Oct. 26, 2016. (Year: 2016).*

CN 105575125 A with English translation; filing date Dec. 15, 2015; published date May 11, 2016. (Year: 2016).*

Code of Federal Regulations, Title 47, Chapter 1, Subchapter D, Part 90, Subpart M, § 90.351; published date: unknown; retrieved on Nov. 30, 2023 from https://www.ecfr.gov/current/title-47/chapter-I/subchapter-D/part-90/subpart-M/section-90.351 (Year: 2023).*

Unknown author(s), "Technical Attachment: Description of CN AEI Readers", published date: unknown; retrieved on Nov. 30, 2023 from https://wireless2.fcc.gov/ (Year: 2023).*

Examination Report dated Sep. 14, 2022 under Section 18 (3) of UK Application No. GB2106262.5.

Second OA received in CN Application No. 201811293771.9; dated Aug. 2, 2023.

Rejection Decision received in CN Application No. 201811293771.9; dated Nov. 3, 2023.

* cited by examiner

TRAIN IDENTIFICATION SYSTEM AND METHOD, AND TRAIN SAFETY INSPECTION SYSTEM AND METHOD

CROSS-REFERENCES TO RELATED APPLICATIONS

The present disclosure is a national phase application of International Application No. PCT/CN2019/109923, filed on Oct. 8, 2019, which claims priority to Chinese Patent Application No. 201811293771.9, filed on Nov. 1, 2018, the entireties of which are incorporated herein by reference.

FIELD

The present disclosure relates to the technical field of train safety inspection, and in particular, to a train identification system and method, and a train safety inspection system and method.

BACKGROUND

In practice, it is of great significance to identify the type or traveling situation of the train, which may automatically know the situation of the passing train, for example, it may be applied in the field of safety inspection or maintenance.

Magnetic steel sensors may be arranged along the rail, the relative speed of the train and the axle position of the train are detected through magnetic steel to determine the axle distance, and the type of the train is identified according to different axle distances. However, in this identification solution, it is necessary to mount the sensor on the railway, which occupies a large area, has a potential safety hazard on the operation of the train and has low capability of responding to the low-speed train, and the mounting points and the number of the sensors are limited, so the detection points are limited. For modified vehicles, for example, the vehicles with the same axle distance parameter are modified into the passenger train or freight train, which cannot be distinguished from the axle distance.

The side profile information of the vehicle may be acquired by a line-scan digital camera to automatically identify the type of the vehicle by a control system. However, this identification solution has a requirement and limitation on the mounting points of the line-scan digital camera, the same train only has one detection opportunity, which has poor adaptability to the speed change, large occupied area, a large number of acquired images, low processing speed and high processing capability on the system.

SUMMARY

A first aspect of embodiments of the present disclosure is to provide a train identification system, including:

a remote detection component, configured to acquire overall feature information of an inspected train through remote monitoring; and an identification device, configured to determine at least one of a type of the inspected train and a traveling situation of the inspected train according to the acquired overall feature information.

In some embodiments, the type of the inspected train includes at least one of a locomotive, a freight train, a passenger train and an engineering train; or the traveling situation of the inspected train includes at least one of:

whether the train is arriving, a traveling direction, a traveling route and a traveling speed of the inspected train.

In some embodiments, the remote detection component includes a camera, configured to shoot video information of the inspected train.

In some embodiments, there are cameras, the plurality of cameras each having various focal distances and being respectively configured to shoot when the inspected train is located in different distance ranges.

In some embodiments, at least one of the shooting angle, installation height and focal distance of the camera is adjustable.

In some embodiments, there is one camera, a video shot by the camera being divided into different areas to correspond to different tracks; or there are cameras, the plurality of cameras being configured to shoot different tracks respectively.

In some embodiments, the remote detection component includes laser detection component or a radar.

A second aspect of embodiments of the present disclosure is to provide a method based on the train identification system as defined in the above embodiment. The method includes:

acquiring overall feature information of the inspected train through remote monitoring by the remote detection component; and judging at least one of the type of the inspected train and the traveling situation of the inspected train according to the acquired overall feature information by the identification device.

In some embodiments, the step of judging at least one of the type and the traveling situation of the inspected train according to the acquired overall feature information by the identification device includes: extracting a feature parameter of the inspected train from the acquired overall feature information, to determine the traveling speed of the inspected train by the identification device, and the step of extracting a feature parameter of the inspected train from the acquired overall feature information, to determine the traveling speed of the inspected train by the identification device includes:

selecting a first position and a second position along a direction of the inspected train from far to near within the field of view of the camera;

acquiring the frame number and the required time of the inspected train from the first position to the second position in the video to acquire a frame rate of the inspected train from the first position to the second position in the video; and comparing the frame rate of the inspected train with the frame rate of the train at a preset traveling speed to acquire the traveling speed of the inspected train.

A third aspect of embodiments of the present disclosure is to provide a train safety inspection system based on the train identification system of the above embodiment. The train safety inspection system includes:

inspection equipment, configured to perform safety inspection on the inspected train;

the train identification system of the above embodiments, arranged in an area adjacent to the inspection equipment; and a radiation control device, configured to control the working state of the inspection equipment according to at least one of the type and the traveling situation of the inspected train determined by the identification device.

In some embodiments, the radiation control device is configured to turn on the inspection equipment for preparation when the identification device determines the presence of a freight train carriage in the coming inspected train, and keep the inspection equipment in a closed state under the absence of the freight train car.

In some embodiments, the radiation control device is configured to enable the inspection equipment to emit rays when the identification device determines that the freight train carriage passes through the inspection equipment, and enable the inspection equipment to stop emitting rays when the identification device determines that a carriage of the locomotive or the passenger train passes through the inspection equipment or the traveling speed of the inspected train is reduced to a preset value or the inspected train stops.

In some embodiments, the radiation control device is configured to adjust the scanning frequency of the inspection equipment to be matched with the traveling speed of the inspected train determined by the identification device.

In some embodiments, the train identification system is integrally arranged on the inspection equipment.

A fourth aspect of embodiments of the present disclosure is to provide a train safety inspection method, including:

judging at least one of the type and the traveling situation of the inspected train; and controlling the working state of an inspection equipment according to the determined at least one of the type and the traveling situation of the inspected train.

In some embodiments, the step of controlling the working state of the inspection equipment according to the determined at least one of the type and the traveling situation of the inspected train includes:

judging whether there is a freight train carriage in the inspected train when judging that the inspected train is coming, if yes, turning on inspection equipment for preparation, if no, the inspection equipment is kept in a closed state.

In some embodiments, the step of controlling the working state of the inspection equipment according to the determined at least one of the type and the traveling condition of the inspected train includes:

judging the type of the inspected train passing through the inspection equipment when the inspection equipment is turned on, enabling the inspection equipment to emit rays for inspection if a freight train carriage passes through the inspection equipment, and enabling the inspection equipment stop emitting rays or reduce the emission dosage of the rays if a carriage of the locomotive or passenger train passes through inspection equipment.

In some embodiments, the step of controlling the working state of the inspection equipment according to the determined at least one of the type and the traveling situation of the inspected train includes:

enabling the inspection equipment to stop emitting rays or reduce the emission dosage of the rays when the traveling speed of the inspected train is reduced to a preset value or the inspected train stops.

In some embodiments, the train safety inspection method further includes:

adjusting the scanning frequency of the inspection equipment to be matched with the traveling speed of the inspected train.

BRIEF DESCRIPTION OF THE DRAWINGS

The accompanying drawings described herein are used to provide further understanding of the present disclosure and constitute a part of the present disclosure. The schematic embodiments of the present disclosure and the description thereof are used to explain the present disclosure, but do not constitute an inappropriate limitation to the present disclosure. In the accompanying drawings.

DETAILED DESCRIPTION OF THE DISCLOSURE

The present disclosure is described hereinafter in detail. In the following paragraphs, different aspects of embodiments are defined in detail. The aspects defined may be combined with one or more of any other aspects unless it is explicitly pointed that they cannot be combined. In particular, any features considered to be preferred or favorable may be combined with one or more of other features considered to be preferred or favorable combination.

The terms "first", "second" and the like appearing in the present disclosure are only used to facilitate description to distinguish different components with the same name, but not to represent a sequence or a primary and secondary relationship.

In the description of the present disclosure, it should be understood that an azimuth or position relationship indicated by terms "upper", "lower", "top", "bottom", "front", "rear", "inner" and "outer" and the like is an azimuth or position relationship based on the accompanying draws, which is only for convenient description of the present disclosure, but not indicates or implies that the referred device must have a specific azimuth and perform construction and operation in the specific azimuth; therefore, it cannot be interpreted as a limitation to the protection scope of the present disclosure.

Embodiments of the present disclosure provide a train identification system and method, and a train safety inspection system and method, the identification flexibility on the train can be improved.

Based on the above technical solutions, in the train identification system according to some embodiments of the present disclosure, the remote detection component acquires the overall feature information of the inspected train through remote monitoring, and the remote detection component may be flexibly arranged outside the area where the train track is located to reduce the requirement on the setting position; furthermore, through remote monitoring, there are many identification opportunities in the traveling process of the train from far to near to improve the identification accuracy, and identification can be performed in advance to give results in time; in addition, basis may be comprehensively provided for judging at least one of the type and the traveling situation of the train by acquiring the overall feature information of the train, the identification accuracy is further improved, and high adaptability to different trains is achieved.

Figure 1:
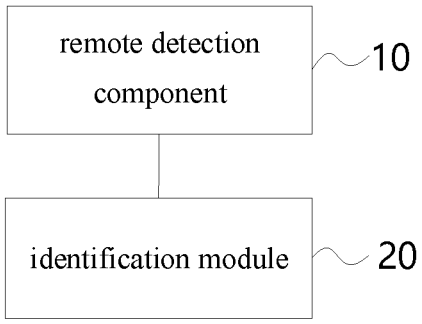
FIG. 1 is a schematic diagram of device composition of some embodiments of a train identification system of the present disclosure.

As shown in FIG. 1, the present disclosure provides a train identification system. In some embodiments, the train identification system includes a remote detection component 10 and an identification device 20, and the remote detection component 10 is configured to acquire overall feature information of the inspected vehicle through remote monitoring, including color or contour of the train. For example, the remote detection component 10 may be arranged on an area located on an outer side of the train in a track width direction. The identification device 20 is configured to extract a feature parameter of the train according to the acquired overall feature information to determine at least of a type and a traveling situation of the inspected train. According to the judgment result of the identification device 20, the train may be subjected to feature diagnosis, maintenance or safety inspection, etc.

The type of the train includes at least one of a locomotive, a freight train, a passenger train and an engineering train. The vehicle type herein may be the overall type of the train or the type of each carriage in a single train. Different vehicle types have different requirements on the follow-up work such as failure diagnosis, maintenance or safety inspection, so judging the vehicle type rapidly and accurately may ensure that the follow-up work is performed correctly.

The traveling situation of the inspected train includes at least one of: whether the train is arriving, the traveling direction, a traveling route and a traveling speed of the inspected train. According to the presence or absence of the train, the start and stop of the working equipment may be controlled in real time, and the working performance parameter of the equipment is matched with the traveling direction, traveling route and/or traveling speed of the inspected train.

Compared with the related technologies, the train identification system according to the embodiment of the present disclosure at least has one of the following advantages:

(1) Since the remote detection component 10 adopts a remote monitoring mode, the remote detection component 10 may be flexibly arranged outside the area where the train track is located through remote monitoring, thus reducing the requirement on the setting position; and the remote detection component can be arranged and mounted close to the working equipment corresponding to the train identification system, which is compact in lay out, small in occupied area and convenient to maintain. The flexibility in choosing the mounting site is higher, without considering bends, turnoffs, stations, etc.

The line-scan digital camera or sensor can perform detection only when the train drives to the position where the detection part is located. Considering the time required for information processing, for early identification, the detection part only can be arranged at a distance away from the working equipment (for example, the inspection equipment), the distance needs to be set according to the traveling speed of the train, occupied area is large and maintenance is inconvenient.

(2) The remote detection component 10 adopts a remote monitoring mode and has many identification opportunities in the process of the train running from far to near to improve the identification accuracy, can perform identification in advance to give results timely for the working equipment to use, has high applicability to the train with high traveling speed, and may be applied to the trains with different traveling speed.

However, when the line-scan digital camera or sensor is adopted, for early identification, the remote detection component 10 only can be arranged in a distance away from the working equipment (for example, the inspection equipment), and it may be necessary to alter the position of the detection part after the train speeds up.

(3) Basis may be comprehensively provided for judging the type and/or the traveling situation of the train by acquiring the overall feature information of the inspected train. When the train difference is small and the traveling speed is high, it is beneficial to improve the identification accuracy, and high applicability to different trains is achieved.

However, whether the line-scan digital camera or sensor is adopted, the local information of the train only can be acquired at the specific position, and it is difficult to obtain accurate results when the train shape difference is small or after modification.

(4) It is unnecessary to splice or integrate train information by acquiring the overall feature information of the inspected train, it is beneficial to directly determine the type and/or the traveling situation of the train, and the information processing speed may be increased, so that the identification capability of the system is improved.

However, when the line-scan digital camera is adopted, it is necessary to splice the acquired images, which has a large number of processed images, low processing speed and low response capability.

In some embodiments, the remote detection component 10 includes: a camera, configured to shoot video information of the inspected train; and an identification device 20, configured to extract feature parameters of the train from video information shot by the camera to determine at least one of the type and the traveling situation of the inspected train. In the video, images of the whole train and part of carriages in the train may be identified and determined.

Key feature parameters of the train may be directly extracted through the video, for example, the color, length, height, axle distance and the like of the train. The train identification system may use a large number of samples for deep learning to match the key feature parameter that represents the type of the inspected train and determine the type of the inspected train. When the type of the train is identified, the camera may shoot from an appropriate angle; moreover, to improve the judgment accuracy, cameras may be mounted for shooting from different angles, thus comprehensively reflecting the detail of each angle of the train.

Furthermore, through the images in the video, whether there is a train coming and the traveling direction may be determined intuitively and accurately, and the traveling route of the train may be directly determined, thus effectively solving the complex track situations such as bends and turnoffs.

In addition, the traveling speed of the inspected train may be accurately acquired through image change in the video. Specifically, a first position and a second position are selected in a direction from far to near within the field of view of the camera, and the frame number and the required time of the inspected train from the first position to the second position are acquired from the video, a frame rate of the inspected train from the first position to the second position in the video is acquired. The frame rate of the inspected train is compared with the frame rate of the train at a preset traveling speed to acquire the traveling speed of the inspected train.

Detection positions may be arranged along the traveling direction of the train in the field of view of the camera, and any two detection positions may serve as the first position and the second position to realize speed detection, so the speed of the inspected train may be detected continuously and uninterruptedly, and the direction of the vehicle may be detected, for example, stopping, backing and other abnormal situations.

In some embodiments, there are cameras. The plurality of the cameras arranged in the same area and each having various focal distances, and the plurality of the cameras are respectively configured to shoot when the inspected train is located in different distance ranges relative to the cameras. The focal distance is directly proportional to the distance range, thus ensuring the video shooting quality in the process of the train traveling from far to near and providing basis for accurate judgment of the identification device 20.

The train may be shot when being located at different distance ranges by mounting the cameras with different focal distances, for example, the camera with a small focal distance shoots the train at a close range, the camera with a large focal distance shoots the train at a long range, and the camera with a medium focal distance shoots the train located at the middle distance position. For example, the camera with a focal distance of 10 mm shoots trains within the working equipment area, the camera with a focal distance of 10 mm to 30 mm takes pictures in the middle distance range, and the camera with a focal distance of more than 30 mm monitors a farther place.

Each camera may cover a range, and the cameras with different focal distances cover different ranges as long as the plurality of cameras realize continuous coverage from far to near without integrating the video shot by each camera. The camera with the largest focal distance starts to perform identification at the earliest, then the adjacent camera, and so on, as long as there is a train within the range of the camera, identification is performed all the time.

Different distance ranges may be observed clearly by using the cameras with different focal distances, it is unnecessary to mounting too many other equipment outside the equipment to detect and observe the local situation, as long as the remote detection components 10 are mounted in a concentrated manner the working equipment area, thus making the overall structures of the remote detection components 10 and the working equipment more compact, reducing occupied space and facilitating maintenance.

In some embodiments, at least one of the shooting angle, installation height and focal distance of each of the cameras is adjustable. By adjusting the shooting angle of the camera, the best shooting angle of the train may be adjusted, and the position of the train on side-by-side rails may also be adjusted; and by adjusting the shooting height of the camera, the position of shooting the far point may be adjusted to allow enough time to identify at least one of the type and the traveling situation of the train. The distance range of the video may be shot as required by adjusting the focal distance of the camera.

Whether there is a train coming may be determined through image analysis and identification of a video stream. After parameters such as the shooting angle, installation height and focal distance of the camera are preset, the first position and the second position may be determined according to the above method to measure the speed of the train.

In some embodiments, if it is necessary to adopt a set of inspection equipment 30 to inspect tracks, two modes may be adopted. First, there is one camera, and the shot video is divided into different areas to correspond to different tracks. Second, there are cameras, the plurality of cameras being configured to shoot different tracks respectively to detect and identify the trains running on different tracks.

The remote detection component 10 in the above embodiment may adopt laser detection component or a radar in addition to the camera. Laser detection may perform scanning in a frequency and perform detection by a laser ranging principle to acquire contour information of the inspected train, thus matching the identified train type, or judging the traveling situation of the train. Radar detection is to use electromagnetic waves to find the inspected train and measure the space position of the inspected train. The radar emits the electromagnetic waves to irradiate the target and receive the echo of the target, thus acquiring information such as a distance from the target to the electromagnetic wave emitting point, a distance change rate (radial speed), an azimuth, a height, etc.

Secondly, the present disclosure further provides an identification method based on the train identification system of the above embodiment. In some embodiments, the identification method includes:

acquiring overall feature information of the inspected train through remote monitoring by the remote detection component 10; and judging at least one of the type of the inspected train and the traveling situation of the inspected train according to the acquired overall feature information by the identification device 20.

In some embodiments, the step of judging at least one of the type and the traveling situation of the inspected train according to the acquired overall feature information by the identification device 20 includes: extracting a feature parameter of the inspected train from the acquired overall feature information, to determine the traveling speed of the inspected train by the identification device 20.

The step of extracting a feature parameter of the inspected train from the acquired overall feature information, to determine the traveling speed of the inspected train by the identification device 20 includes:

selecting a first position and a second position along a direction of the inspected train from far to near within the field of view of a camera;

acquiring the frame number and the required time of the inspected train from the first position to the second position in the video, to acquire a frame rate of the inspected train from the first position to the second position in the video; and comparing the frame rate of the inspected train with the frame rate of the train at a preset traveling speed, to acquire the traveling speed of the inspected train.

According to the embodiments, the traveling speed of the inspected train may be accurately acquired through image change in the video.

Figure 2:
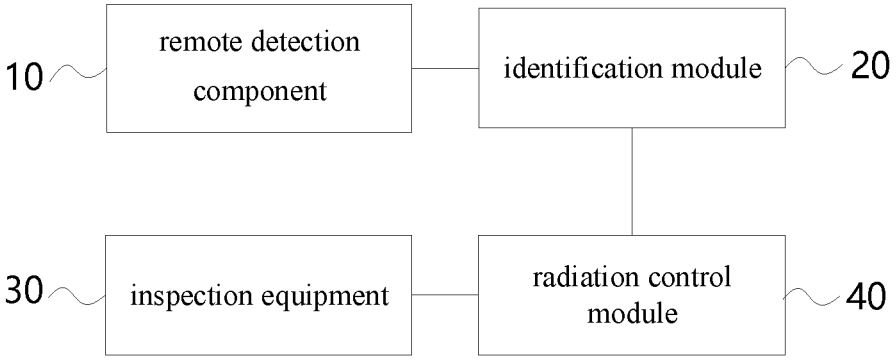
FIG. 2 is a schematic diagram of device composition of some embodiments of a train safety inspection system of the present disclosure.

Thirdly, the present disclosure further provides a train safety inspection system, as shown in FIG. 2, including inspection equipment 30, a radiation control device 40 and the train identification system of the above embodiment. The inspection equipment 30 is configured to perform safety inspection on the inspected train. When it is necessary to perform scanning inspection, a ray source in the inspection equipment 30 emits rays to perform scanning inspection on the passing train and determine whether goods in the train meet the safety standard. The train identification system is arranged in an area adjacent to the inspection equipment 30, and the radiation control device 40 is configured to control the working state of the inspection equipment 30 according to at least one of the type and traveling situation of the inspected train determined by the identification device 20.

In this embodiment, the remote detection component 10 adopts a remote monitoring mode, so the remote detection component 10 may be arranged in the area adjacent to the inspection equipment 30, the equipment is compact in overall layout, small in occupied area and convenient to maintain. The flexibility in choosing the mounting site is higher, without considering bends, turnoffs, stations, etc.

Furthermore, the remote detection component 10 may accurately determine the type and the traveling situation of the train, and may accurately control the time of the inspection equipment 30 starting, stopping and emitting rays. In addition, the remote detection component 10 can identify the type and the traveling situation of the train in advance and increase the information processing speed, and enables the inspection equipment 30 to inspect the goods in the train comprehensively and timely, thus avoiding missing detection.

However, since it is necessary to spice images when the line-scan digital camera is adopted in the related technologies, for early identification, the remote detection component 10 only can be arranged in a distance away from the inspection equipment 30, the whole train safety inspection system needs to occupy a large space and needs to be maintained respectively in different places. Furthermore, the train can only be identified once and the accuracy of the identification result is not high, which may lead to missing inspection of the listed goods.

In some embodiments, the radiation control device 40 is configured to turn on the inspection equipment 30 for preparation and other preparatory work when the identification device 20 determines the presence of a freight train carriage in the coming inspected train and keep the inspection equipment 30 in a closed state under the absence of the freight train carriage, for example, the train is single locomotive or double locomotive and other structures without carriages, or the whole train is a passenger train, etc.

Through remote monitoring of the remote detection component 10, the identification device 20 may determine whether there is a freight train carriage in the coming inspected train in advance, if there is a freight train carriage in the coming inspected train, the inspection equipment 30 is turned on to prepare in advance, and then rays are emitted when the freight train carriage passes through the inspection equipment 30, the inspection equipment can be in an inspection state timely when the freight train carriage passes. If there is no freight train carriage, the inspection equipment 30 is kept closed, thus reducing the power consumption of the inspection equipment 30 and equipment loss.

In some embodiments, the radiation control device 40 is configured to enable the inspection equipment 30 to emit rays when the identification device 20 determines that there is a freight train carriage passing through the inspection equipment 30, and enable the inspection equipment 30 to stop emitting rays or reduce the emission dosage of the rays when the identification device 20 determines that there is a locomotive or passenger train carriage passing through the inspection equipment 30 or the traveling speed of the inspected train is reduced to a preset value or the inspected train stops.

When the embodiment identifies that there is a freight train carriage passing through the inspection equipment 30, rays are emitted to inspect goods, the goods carried in the train may be comprehensively inspected; and when the locomotive or passenger train carriage passes through the inspection equipment 30, ray emission is stopped, or the emission dosage of the rays is reduced, damage to the personnel by the rays can be reduced, and the train inspection safety of the inspection equipment 30 can be improved. In addition, when the traveling speed of the train is reduced to the preset value or the train stops, the inspection equipment 30 may stop emitting rays to prevent people from coming out of the train.

In some embodiments, the radiation control device 40 is configured to adjust the scanning frequency of the inspection equipment 30 to be matched with the traveling speed of the inspected train determined by the identification device 20. The traveling speed of the train is acquired by the video stream, and the scanning frequency of the inspection equipment 30 may be adjusted in real time to ensure that the scanned image is not distorted, the goods situation inside the freight train is observed more clearly.

In some embodiments, the train identification system is integrally arranged on the inspection equipment 30. Therefore, the remote detection component 10 does not need to occupy additional space, the equipment layout is compact, the occupied area is small, and scanning of the arrangement and mounting of the inspection equipment 30 is facilitated; furthermore, the train safety inspection system, serving as overall equipment, is maintained, and the flexibility in selecting the mounting site is higher, without considering bends, turnoffs, stations, etc. In addition, the identification device 20 may be arranged independently and may also be integrally arranged with the control system of the inspection equipment 30.

Figure 3:
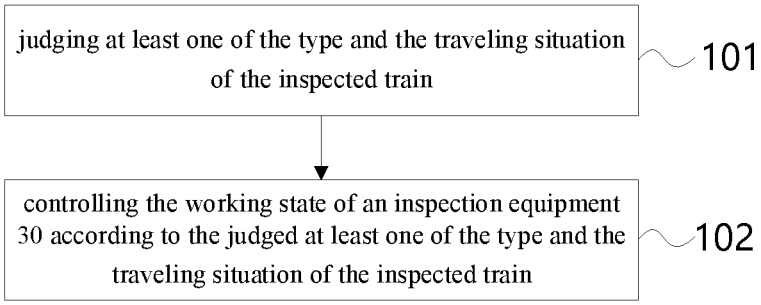
FIG. 3 is a flow schematic diagram of some embodiments of a train safety inspection method of the present disclosure.

Finally, the present disclosure provides an inspection method based on the train identification system or train safety inspection system. In some embodiments, as shown in FIG. 3, the inspection method includes:

Step 101: judging at least one of the type and the traveling situation of the inspected train; and Step 102: controlling the working state of an inspection equipment 30 according to the determined at least one of the type and the traveling situation of the inspected train.

Step 101 may be performed by the identification device 20 in real time, and Step 102 may be performed by the radiation control device 40. In this embodiment, since the remote detection component 10 adopts the remote monitoring mode, the remote detection component 10 may accurately determine the type and the traveling situation of the train, and may accurately control the time of the inspection equipment 30 starting, stopping and emitting rays. In addition, the remote detection component 10 can identify the type and the traveling situation of the train in advance and increase the information processing speed, and enables the inspection equipment 30 to inspect the goods in the train comprehensively and timely, thus avoiding missing detection.

Figure 4:
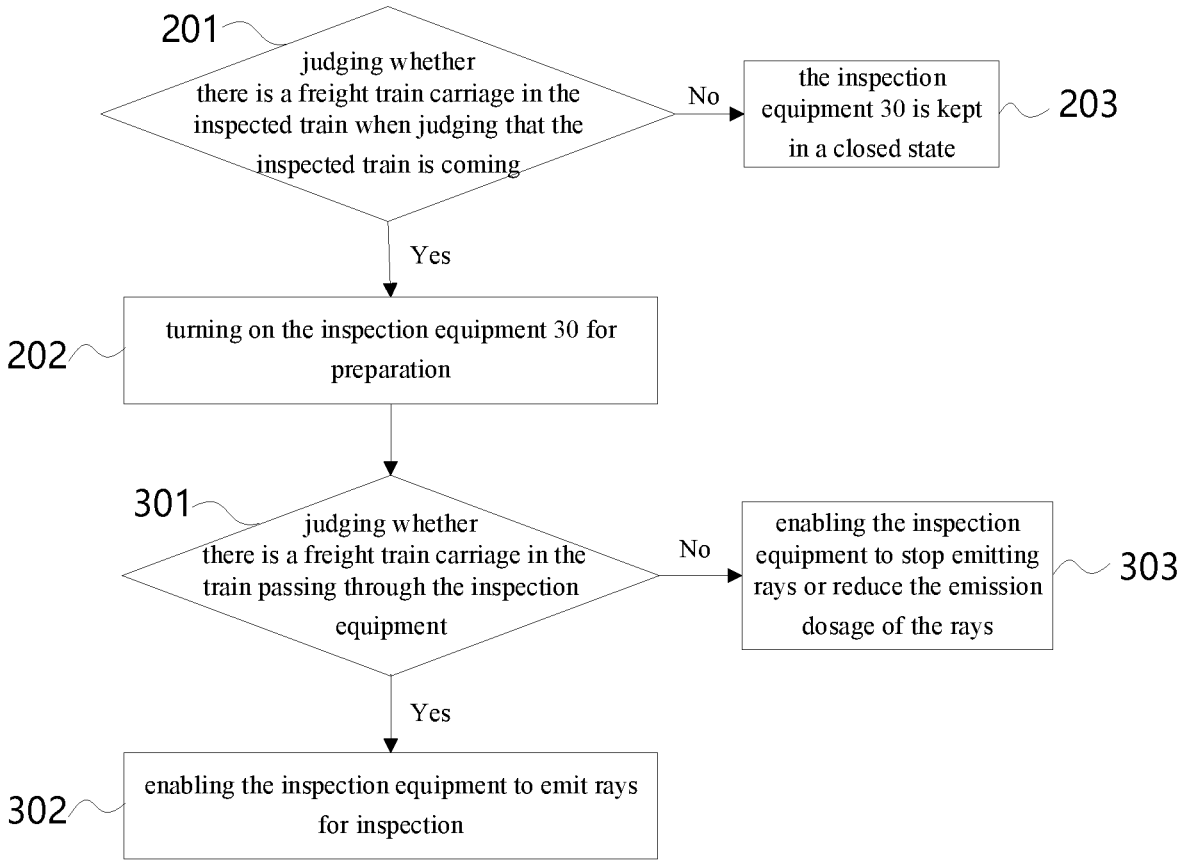
FIG. 4 is a flow schematic diagram of some other embodiments of a train safety inspection method of the present disclosure.

In some embodiments, as shown in FIG. 4, Step 102 includes:

Step 201: judging whether there is a freight train carriage in the inspected train when it is determined that the inspected train is coming, if yes, Step 202 is performed, if no, Step 203 is performed;

step 202: turning on the inspection equipment 30 for preparation; and

Step 203: the inspection equipment 30 is kept in a closed state.

Steps 201-203 are performed by the radiation control device 40. According to the embodiment, the inspection equipment can enter an inspection state timely when the freight train carriage passes, and the inspection equipment 30 may be kept closed under the condition that there is no freight train car, power consumption of the inspection equipment 30 and the equipment loss may be reduced.

In some embodiments, as shown in FIG. 4, Step 102 includes:

Step 301: judging the type of the inspected train passing through the inspection equipment 30 when the inspection equipment 30 is turned on, Step 302 is performed if there is a freight train carriage passing through the inspection equipment 30, and Step 303 is performed if there is a locomotive or passenger train carriage passing through the inspection equipment 30;

Step 302: enabling the inspection equipment 30 to emit rays for inspection; and Step 303: enabling the inspection equipment 30 to stop emitting rays or reduce the emission dosage of the rays.

Steps 301-303 are performed by the radiation control device 40. When the embodiment identifies that there is a freight train carriage passing through the inspection equipment 30, rays are emitted to inspect goods, the goods carried in the train may be comprehensively inspected; and when the locomotive or passenger train carriage passes through the inspection equipment 30, ray emission is stopped, or the emission dosage of the rays is reduced, damage to the personnel by the rays can be reduced, and the train inspection safety of the inspection equipment 30 can be improved.

In some embodiments, Step 102 includes: enabling the inspection equipment 30 to stop emitting rays or reduce the emission dosage of the rays when the traveling speed of the inspected train is reduced to a preset value or the inspected train stops. The embodiment is to prevent people coming out of the train from being damaged by the rays to improve the personnel safety.

In some embodiments, the train safety inspection method according to the present disclosure further includes:

Step 103: adjusting the scanning frequency of the inspection equipment 30 to be matched with the traveling speed of the inspected train.

Step 103, not shown in the figure may be performed by the radiation control device 40, and may be adjusted at any time after the train appears in the video and before the train passes through the inspection equipment 30. The traveling speed of the train is acquired by the video stream, and the scanning frequency of the inspection equipment 30 may be adjusted in real time to ensure that the scanned image is not distorted, the goods situation inside the freight train is observed more clearly.

Therefore, according to the train identification system and method provided by the present disclosure, whether there is a train coming, the traveling speed, the traveling direction and the type of the train can be detected remotely without arranging a sensor, a detection device and the like at positions far away from the inspection equipment 30, the occupied area may be effectively reduced and devices are prevented from being mounted on the rail. Furthermore, the type of the train can be determined through real-time identification for many times, and for the single rail, double rails, even more rails, bends, turnoffs and other complex rails, the comprehensive judgment capability of the system can be improved, the use safety of the inspection equipment 30 is improved, the influence on the sensor by the train on the track due to bumping and other conditions is reduced, and basis is provided for stable and reliable operation of the inspection equipment 30.

A train identification system and method, and a train safety inspection system and method provided by the present disclosure are described in detail above. The principle and embodiments of the present disclosure are elaborated by an embodiments, and the description of the above embodiments is only intended to help understand the method of the present disclosure.

What is claimed is:

1. A train identification system, comprising:

a remote detection component, configured to acquire overall feature information of an inspected train through remote monitoring; and an identification device, configured to determine that at least one of a type of the inspected train and a traveling situation of the inspected train according to the acquired overall feature information, wherein the remote detection component comprises one or more cameras, configured to shoot video information of the inspected train;

the one or more cameras comprise one camera, a video shot by the camera being divided into different areas to correspond to different tracks; or the one or more cameras comprise a plurality of cameras, the plurality of cameras being configured to shoot different tracks respectively.

2. The train identification system according to claim 1, wherein the type of the inspected train comprises at least one of a locomotive, a freight train, a passenger train and an engineering train; or the traveling situation of the inspected train comprises at least one of: whether the inspected train is arriving, a traveling direction, a traveling route and a traveling speed of the inspected train.

3. The train identification system according to claim 1, wherein the one or more cameras comprise a plurality of cameras, the plurality of cameras each having various focal distances and being respectively configured to shoot when the inspected train is located in different distance ranges.

4. The train identification system according to claim 1, wherein at least one of a shooting angle, installation height and focal distance of the one or more cameras are adjustable.

5. A train safety inspection method, comprising:

acquiring overall feature information of an inspected train through remote monitoring by a remote detection component;

determining that at least one of a type of the inspected train and a traveling situation of the inspected train according to the acquired overall feature information by an identification device; and controlling a working state of an inspection equipment according to a determinationof at least one of the type and the traveling situation of the inspected train;

wherein the remote detection component comprises one or more cameras, configured to shoot video information of the inspected train;

the one or more cameras comprise one camera, a video shot by the camera being divided into different areas to correspond to different tracks; or the one or more cameras comprise a plurality of cameras, the plurality of cameras being configured to shoot different tracks respectively.

6. The train safety inspection method according to claim 5, wherein controlling the working state of the inspection equipment according to the determination of at least one of the type and the traveling situation of the inspected train comprises:

judging whether there is a freight train carriage in the inspected train when judging that the inspected train is coming, if yes, turning on the inspection equipment for preparation; if no, the inspection equipment is kept in a closed state.

7. The train safety inspection method according to claim 5, wherein controlling the working state of the inspection equipment according to the determination that at least one of the type and the traveling situation of the inspected train comprises:

determining the type of the inspected train passing through the inspection equipment when the inspection equipment is turned on, enabling the inspection equipment to emit rays for inspection if a freight train carriage passes through the inspection equipment, and enabling the inspection equipment to stop emitting rays or reduce an emission dosage of the rays if a carriage of a locomotive or passenger train passes through the inspection equipment.

8. The train safety inspection method according to claim 5, wherein controlling the working state of the inspection equipment according to the determination that at least one of the type and the traveling situation of the inspected train comprises:

enabling the inspection equipment to stop emitting rays or reduce an emission dosage of the rays when a traveling speed of the inspected train is reduced to a preset value or the inspected train stops.

9. The train safety inspection method according to claim 5, further comprising:

adjusting a scanning frequency of the inspection equipment to be matched with a traveling speed of the inspected train.

10. The train safety inspection method according to claim 5, wherein judging at least one of the type and the traveling situation of the inspected train according to the acquired overall feature information by the identification device comprises: extracting a feature parameter of the inspected train from the acquired overall feature information, to determine a traveling speed of the inspected train by the identification device;

wherein extracting a feature parameter of the inspected train from the acquired overall feature information, to determine the traveling speed of the inspected train by the identification device comprises:

selecting a first position and a second position along a direction of the inspected train from far to near within a field of view of a camera;

acquiring a frame number and a required time of the inspected train from the first position to the second position in a video, to acquire a frame rate of the inspected train from the first position to the second position in the video; and comparing the frame rate of the inspected train with the frame rate of the inspected train at a preset traveling speed, to acquire the traveling speed of the inspected train.

11. A train safety inspection system, comprising:

inspection equipment, configured to perform safety inspection on an inspected train;

a train identification system, arranged in an area adjacent to the inspection equipment, wherein the train identification system comprises a remote detection component and an identification device, the remote detection component is configured to acquire overall feature information of an inspected train throgh remote monitoring, the identification device is configured to determine that at least one of a type of the inspected train and a traveling situation of the inspected train according to the acquired overall feature information; and a radiation control device, configured to control a working state of the inspection equipment according to at least one of the type and the traveling situation of the inspected train determined by the identification device;

wherein the remote detection component comprises one or more cameras, configured to shoot video information of the inspected train;

the one or more cameras comprise one camera, a video shot by the camera being divided into different areas to correspond to different tracks; or the one or more cameras comprise a plurality of cameras, the plurality of cameras being configured to shoot different tracks respectively.

12. The train safety inspection system according to claim 11, wherein the radiation control device is configured to turn on the inspection equipment for preparation when the identification device determines that presence of a freight train carriage in the coming inspected train, and keep the inspection equipment in a closed state under the absence of the freight train carriage.

13. The train safety inspection system according to claim 11, wherein the radiation control device is configured to enable the inspection equipment to emit rays when the identification device determines that a freight train carriage passes through the inspection equipment, and enable the inspection equipment to stop emitting rays when the identification device determines that a carriage of a locomotive or a passenger train passes through the inspection equipment or a traveling speed of the inspected train is reduced to a preset value or the inspected train stops.

14. The train safety inspection system according to claim 11, wherein the radiation control device is configured to adjust a scanning frequency of the inspection equipment to be matched with a traveling speed of the inspected train determines by the identification device.

15. The train safety inspection system according to claim 11, wherein the train identification system is integrally arranged on the inspection equipment.

* * * * *